US006499910B1

(12) United States Patent
Grahmbeek et al.

(10) Patent No.: US 6,499,910 B1
(45) Date of Patent: Dec. 31, 2002

(54) METHOD FOR APPLYING GUIDELINES FOR VISUALLY HANDICAPPED PERSONS

(75) Inventors: Antonius Jacob Grahmbeek, Egmond Binnen (NL); Tamar Vanessa Grahmbeek, Surinameplein 55, 1058 GN Amsterdam (NL)

(73) Assignees: Tamar Vanessa Grahmbeek (NL); Marit Astrid Grahmbeek (NL)

( * ) Notice: Subject to any disclaimer, the term of this patent is extended or adjusted under 35 U.S.C. 154(b) by 0 days.

(21) Appl. No.: 09/273,626

(22) Filed: Mar. 23, 1999

(30) Foreign Application Priority Data

Mar. 25, 1998 (NL) ..... 10008708

(51) Int. Cl.[7] ..... E01C 7/06

(52) U.S. Cl. ..... 404/75; 404/72

(58) Field of Search ..... 404/9, 15, 42; 116/63 R

(56) References Cited

U.S. PATENT DOCUMENTS

| | | | | | |
|---|---|---|---|---|---|
| 4,715,743 | A | * | 12/1987 | Schmanski | 404/9 |
| 4,813,811 | A | * | 3/1989 | Adams | 404/15 |
| 5,271,690 | A | * | 12/1993 | Fennessy, Sr. | 404/9 |
| 5,302,049 | A | * | 4/1994 | Schmanski | 404/42 |
| 5,320,790 | A | * | 6/1994 | Lowe | 264/31 |
| 5,328,293 | A | * | 7/1994 | Keefe | 404/9 |
| 5,415,493 | A | * | 5/1995 | Eaton | 404/15 |
| 5,764,060 | A | * | 6/1998 | Gonzalez et al. | 324/326 |
| 5,827,009 | A | * | 10/1998 | Kokoletsos | 404/75 |
| 5,853,846 | A | * | 12/1998 | Clark et al. | 428/131 |

* cited by examiner

*Primary Examiner*—Gary S. Hartmann
(74) *Attorney, Agent, or Firm*—Hayes Soloway PC

(57) ABSTRACT

A method of applying guidelines or guide ribs in the walking direction for visually handicapped persons. The method involves the steps of providing a mold having a plurality of slots arranged in mutually spaced rows, placing the mold in contact with a travel surface with the slots aligned relative to a travel path, filling the slots with a synthetic resin and permitting the resin to set, and then removing the mold.

11 Claims, 2 Drawing Sheets

METHOD FOR APPLYING GUIDELINES FOR VISUALLY HANDICAPPED PERSONS

The invention relates to a method for the application of guidelines for visually handicapped (V.H.) on an existing subsoil of one that can be fixed subsequently.

The guideline is used in those places where the natural guidelines for the visually handicapped person, such as walls, hedges, fences, are lacking or are unsuitable. It is also possible to draw the attention of the visually handicapped person to a place for crossing the road, intersection, or other dangerous situations.

The guideline should be recognisable for the visually handicapped person and should therefore differ from the local subsoil.

The guideline or guidepath comprises of one or more groups of ribs that are parallel next to each other. In the longitudinal direction these ribs are, preferably regularly, interrupted in connection with the removal of water and dirt.

The present novel method for the application of ribs has considerable advantages with regard to the manner in which the guidepaths are realised up to now.

By using carton molds with recesses for the formation of ribs and applying epoxy material in these recesses and scraping off the excess material, after the removal of the molds one obtains ribs which are clearly recognisable as guidelines for the visually handicapped person. In order to compensate for irregularities of the subsoil, the molds should be flexible.

The invention will now further be ellucidated referring to the accompanying drawings of an embodiment.

Figure 1:
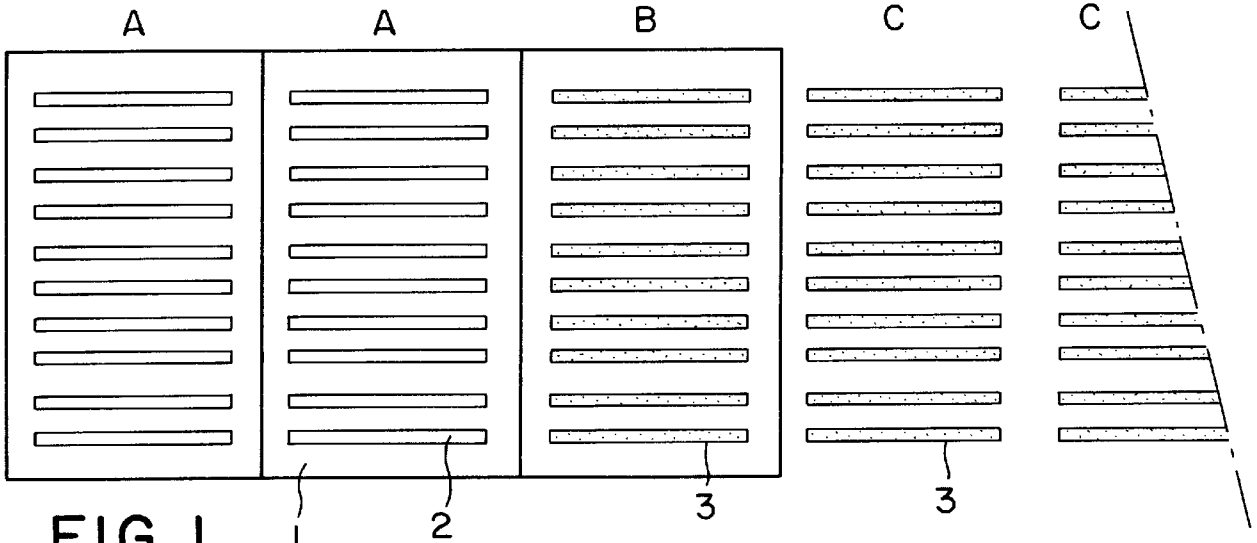
FIG. 1A shows the molds (1) on the subsoil with recesses (2).
FIG. 1B shows a mold with epoxy material that has been arranged therein.
FIG. 1C shows the rib pattern that is obtained.
Figure 2:
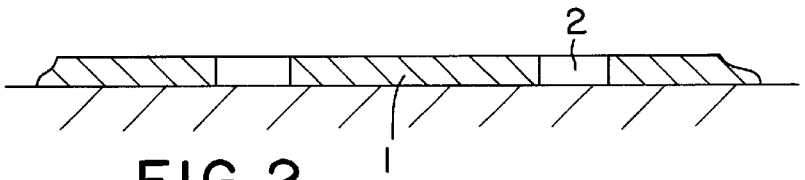
FIG. 2 shows the mold (1) on the subsoil.
Figure 3:
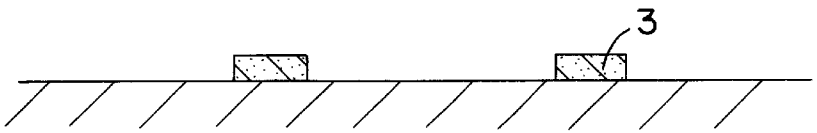
FIG. 3 shows a cross-section of the ribs (3) that have been applied.
Figure 4:
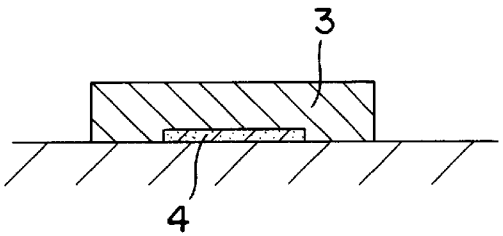
FIG. 4 shows a cross-section of a rib in which, such as described before, a strip to be detected is incorporated.

In FIG. 1 the molds have been indicated with (1) with three groups of 10 punched out recesses (2) parallel and next to each other. The mold (1) should be flexible in order to compensate for the irregularities of the subsoil.

The mold (1) can be made of paper, for instance for an exclusive anti-slip application, in which a low profile is already sufficient, out of (corrugated) carton of one or more millimeter thickness. The thickness of the mold, (1) determines the height of the rib (3) and is therefore also chosen in connection with the flatness of the subsoil. In those places where the rib should possibly be interrupted, for instance at a (dilatation) joint, a part of the recesses in the mold is covered with tape. The ends of the ribs are rounded off to promote the easy removal of dirt and water.

After the necessary preconditioning of the subsoil, which can be of stone, wood, (asphalt) concrete, steel, plastic, etc., the molds are positioned on the subsoil against each other in the desired pattern and fixed with for instance adhesive tape. If desired one may mount one or more (non-)ferro (adhesive) strips into the recesses.

Figure 5:
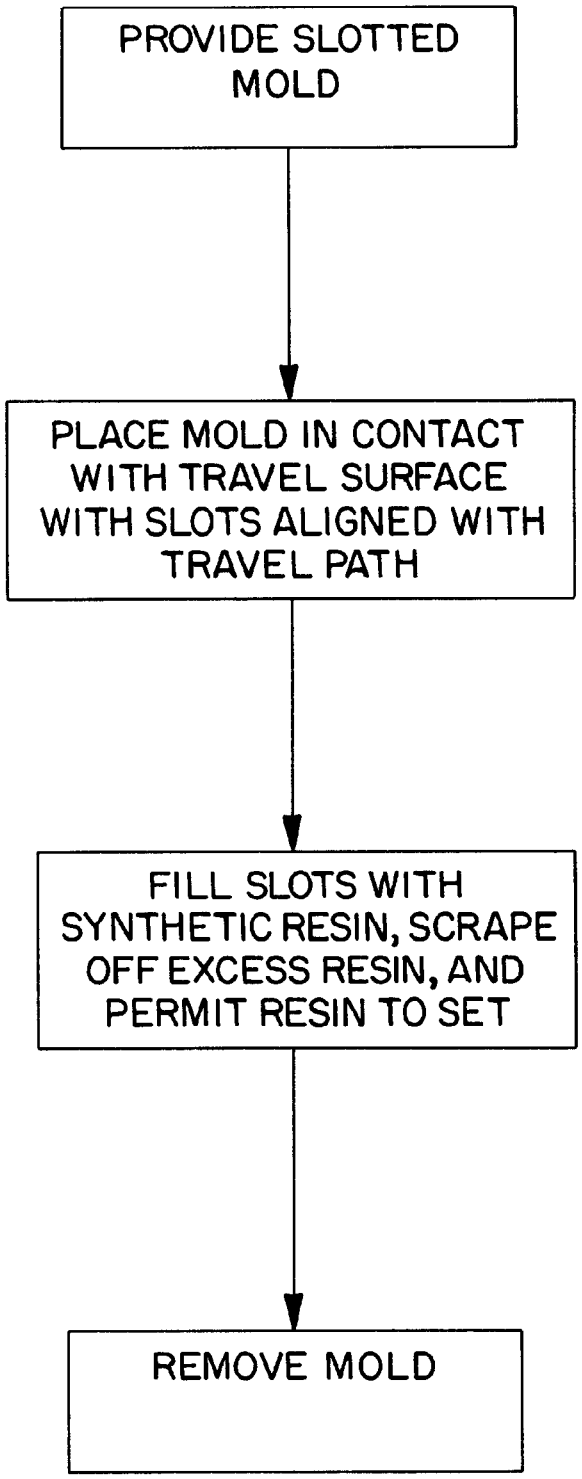
FIG. 5 is a flow diagram showing the method of the present invention.

More or less moldable synthetic resin, preferably epoxy resin, is filled into the recesses with for instance a filling knife and the excess is scraped off. When one wishes to have a cross-section of the ribs (3) with sharp corners one lets the epoxy material harden for sometime, after which one removes the molds by lifting cross section in a vertical direction. This process is detailed in FIG. 5. When one wishes to have a rib which is somewhat rounded off, one uses a somewhat thinner epoxy resin and removes the mold immediately after the application of the resin. As a result thereof, the rib will flow out at the upper-side. After removal of the mold the fresh guideline, depending on the temperature, should be kept covered for 6 to 24 hours in order to harden.

The strength against wear is improved by adding (quartz) powder having a high strength against wear, and also pigment in order to obtain the required color.

For the anti-slip application it is possible to add anti-slip grains in advance to the epoxy resin, or scatter the grains later on and pound or roll the epoxy resin, before removing the moulds. Then one obtains anti-slip lines in a certain patterns which functions in a better way than complete surfaces with anti-slip material.

As an embodiment guidelines for railway platforms are mentioned, which are applied on tiles of 40×40 centimeters which have already been fixed, on which tiles a pattern of ten ribs of a length of 35 centimeter are applied next to each other with a width of paths of 55 centimeter. The same pattern can also be applied on platforms having a subsoil of asphalt and concrete. Also loose tiles etc. can be provided with ribs in this way.

For the guidelines or guideribs one can choose, depending on the local subsoil, forms, dimensions, roughness, (contrasting) color, also for relatively small lengths.

According to another embodiment the ribs 3 are prefabricated and preferably provided at the lower side with a contact glue covered with a cover sheet that is removed just before placing the rib in the recess of the mold that has been aligned on the subsoil. These prefabricated ribs can contain quartz powder having a high strength against wear, pigments for obtaining the required color, anti-slip grains, and/or magnetic material that can be activated with a sensor.

From the Point of View of the Visually Handicapped Person this will be

Visual requirements: width of line or rib, (contrasting) color, with regard to the subsoil.

Tactile requirements: cross-section of the rib; height, width, somewhat rounded off edges yes or no, roughness, number of ribs next to each other and the length thereof.

Auditive requirements: material of the rib differs with regard to the subsoil, giving a higher attention value. Distance between the ribs can be chosen to obtain an optimal vibration/noise with the cane.

It is possible to apply in a simple manner a (non) ferro metal strip in the rib, for instance an adhesive copper strip. With a small metal detector in the point of the blind cane or in the shoe a small magnetic field will be formed, with which an audio or vibration signal can be created. The visually handicapped person will be able to use this as the most important or as an additional route guidance.

From the Point of View of Security and Inconvenience

The width and height, sharpness of the corners, roughness and color of the ribs can be chosen optimally. Because of the relatively low height of the ribs there is less chance of so-called rail formation. Because of these relatively low ribs people with for instance bags with wheels suffer less inconvenience and there is less danger for people with a shuffling gate. Removal of dirt and water (formation of ice) take better place, also because the ribs are interrupted in longitudinal direction.

From the Point of View of Durability

With a proper preliminary treatment of the subsoil, that is cleaning and removing of oil and roughning if necessary, the bond created between the rib of epoxy resin and the subsoil is usually greater than the solidity of the subsoil itself. As the lines can be interrupted at the location of the joints there is no crack when there is subsidence. The epoxy material to be used is chemically durable so that oil, aggressive cleaning agents, salts and such have no influence. By adding more or less quartz powder to the epoxy materials a strength against wear is created which is as a rule greater than that of the subsoil.

From the Point of View of Maintenance

As the attention value of the rectangular rib is greater than that of a rib which is strongly rounded off, this rib can stay relatively low. Accumulation of dirt is therefore less. These ribs are also interrupted, so that cleaning and removal of water is made easier. Possible damages can be repaired simply.

From the Point of View of Aesthetics:

The ribs are tight arid can be adapted optimally to the possible joints in the subsoil. The ribs can be made in the desired (contrasting) color and brightness, by the addition of pigment, keeping the color design of the surrounding into account. As only the ribs have a differing color with regard to the subsoil and no broad lanes, such as with the rib tile, the guidelines are less predominant.

From the Point of View of Applicability

The system is suitable for both inside and outside applications and can be easily connected to guidelines. The guidelines can follow for instance bands in the platforms. Also when only a single one meter guideline should be applied, this is now possible. With this system it is possible to make "start" and "end" indications of stairs, in combination with anti-slip ribs yes or no.

From the Point of View of the Non-Visually Handicapped Person

By making a ribline for instance in a different color, this can be used as a reference for the non-visually handicapped person. A red line to the (emergency) exit, a blue line to the ticket office window for instance, etc.

What is claimed is:

1. A method of applying guidelines to mark a travel path on a travel surface as route guiding information for visually handicapped persons, which comprises the steps in sequence of:

(a) providing a mold having a plurality of slots arranged in mutually spaced rows;

(b) placing said mold in contact with said travel surface with the slots aligned substantially in the direction of the travel path;

(c) filling the slots with a synthetic resin, scraping off excess resin, and permitting the resin to set; and (d) removing the mold.

2. A method according to claim 1, wherein the synthetic resin comprises an epoxy resin.

3. A method according to claim 1, including the step of adding quartz powder and a pigment to the synthetic resin.

4. A method according to claim 3, wherein said quartz powder and pigment are arranged at least at an upper surface of the guidelines.

5. A method according to claim 1, and including the step adding anti-slip grains to the synthetic resin.

6. A method according to claim 1, and including the steps of adding a material detectable by magnetic activation to the resin.

7. A method according to claim 1, wherein the mold is made of a thin flexible sheet material, and said slots have a rectangular cross-section in the shape of narrow channels with the rounded off corners.

8. A method according to claim 1, wherein the sheet material is paper or cardboard.

9. A method according to claim 1, wherein the mold comprises a plurality of like slots.

10. A method according to claim 1, wherein the mold comprises a group of 10 slots aligned next to each other, each said slot having a length of 35 centimeters, a width of 1 centimeter with rounded off edges, a height of 0.5 centimeter, and spaced from an adjacent slot by centimeters.

11. A method according to claim 1, wherein the synthetic resin comprises a two component resin system.

* * * * *

UNITED STATES PATENT AND TRADEMARK OFFICE

CERTIFICATE OF CORRECTION

PATENT NO. : 6,499,910 B1 
DATED : December 21, 2002
INVENTOR(S) : Grahmbeek et al.

It is certified that error appears in the above-identified patent and that said Letters Patent is hereby corrected as shown below:

Column 4,
Line 21, after "step" insert -- of --.
Line 29, delete "the".
Line 30, "1" should read -- 7 --.
Line 30, after "the" insert -- thin --.
Line 34, "1" should read -- 9 --.

Signed and Sealed this

Twenty-second Day of June, 2004

JON W. DUDAS
*Acting Director of the United States Patent and Trademark Office*